US008313167B2

(12) United States Patent
Anderson et al.

(10) Patent No.: US 8,313,167 B2
(45) Date of Patent: Nov. 20, 2012

(54) TILED MANIFOLD FOR A PAGE WIDE PRINTHEAD

(75) Inventors: Frank Edward Anderson, Sadieville, KY (US); Richard Earl Corley, Jr., Richmond, KY (US); Michael John Dixon, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 486 days.

(21) Appl. No.: 12/568,739

(22) Filed: Sep. 29, 2009

(65) Prior Publication Data

US 2011/0074879 A1 Mar. 31, 2011

(51) Int. Cl.
*B41J 2/155* (2006.01)

(52) U.S. Cl. ..... 347/42; 347/49

(58) Field of Classification Search ..... 347/13, 347/42, 49, 64, 65

See application file for complete search history.

(56) References Cited

U.S. PATENT DOCUMENTS 7,416,277 B2 * 8/2008 Silverbrook et al. ..... 347/42

* cited by examiner

*Primary Examiner* — Lamson Nguyen

(57) ABSTRACT

An ink manifold constructed with a number of semiconductor tiles which are fastened end to end on a rigid base member to form a page wide print mechanism. Each tile is constructed with ink channels on one side in liquid communication with ink outlet ports on the opposite side. The ink channels carry ink from ports in the base member to the outlet ports of the tiles. The interface between each tile defines a boundary. An inkjet printhead is fastened over each boundary of the tiled manifold so that the ink inlet ports of the printhead are aligned with the ink outlet ports of the underlying tiles. No ink passes across the boundary of the adjacent manifold tiles. The fabrication of the individual tiles from a semiconductor wafer facilitates usage of the wafer when fabricating page wide print mechanisms.

9 Claims, 4 Drawing Sheets

TILED MANIFOLD FOR A PAGE WIDE PRINTHEAD

BACKGROUND

1. Field of the Invention

The present invention relates generally to inkjet printheads, and more particularly to ink delivery manifolds employed with page wide printheads.

2. Description of the Related Art

Printers, copiers and other related reproduction equipment often employ printheads to deposit ink onto a print medium to provide readable characters. A programmed controller is often utilized to rasterize the data and couple the same to the printhead to cause droplets of ink to be deposited on the print medium in the form of characters, such as letters, symbols, images, etc. Printheads are typically constructed with a number of miniature nozzles that are electrically addressable to cause ink to be jetted from desired nozzles to form the characters on the print medium.

Reproduction equipment utilizing inkjet printheads often use a single printhead that is moved back and forth in a swath laterally across the print medium to deposit ink dots in desired positions along a line. Once each line of ink dots is printed, the print medium is incrementally advanced to print another sequence of ink dots. As a number of lines of ink dots are incrementally printed on the medium, a string of letters or other characters is formed. Each additional string of characters is formed in the same manner, namely alternately moving the printhead in a swath across the print and incrementally advancing the paper.

Another technique for printing characters is to employ a page wide printhead which extends laterally across the print medium. With this technique, the page wide printhead does not move, but rather prints a single line of ink dots substantially simultaneously. Then, the print medium is advanced so that a subsequent line of ink dots can be printed. As can be appreciated, the use of the page wide printhead significantly reduces the time required to print a string or page of characters.

While the utilization of a page wide printhead is an efficient method for quickly printing many characters, the construction of such type of printheads is more complicated and thus more costly and prone to manufacturing errors. Many of the components of a printhead are constructed using semiconductor wafers and corresponding processing techniques. As such, the fabrication of a page wide printhead for standard letter-size paper, requires a printhead having a length approximately equal to the width of the target print media. In this instance, the conventional practice is to use a number of individual printheads that are mounted on a support that spans the width of the print medium. The printheads are staggered or offset so that a standard space exists between the last nozzle of one printhead and the first nozzle of the adjacent printhead.

In addition to printheads, a manifold is often used to couple the liquid ink from a reservoir to the various nozzles of the individual printheads. The manifold construction is more complicated when it is desired to print characters in color. If, for example, magenta, yellow, cyan and black ink colors are utilized for the primary colors to print an image of any color, then the manifold must have at least four different channels to accommodate the four different colors of ink. Moreover, the different ink channels must be extended to the various nozzle structures of the individual printheads. It can thus be appreciated that the construction of the ink manifold is complicated, in that very small channels must be formed in circuitous paths in the manifold to couple the liquid ink to the individual nozzle structures. Owing to the fact that the individual printheads can each have thousands of nozzles, the ink delivery manifold can be challenging to manufacture.

Because of its complexity, a manifold for routing liquid ink from a source to the printhead nozzles is often constructed of a semiconductor material which can be processed with micron-size features. The manifold can be made in two halves, each etched to form the desired features, such as the many ink channels, and then bonded together so that the ink channels are closed, except at the input end, and the output ends which are mated to the printhead nozzles. However, even when manufacturing manifolds for page wide printheads, the semiconductor material often needs to be as long as the print medium is wide. In other words, the semiconductor manifold can be made eight and one-half inches long for printing on a letter-size page. This may require a ten-inch diameter semiconductor wafer to make several ink delivery manifolds. While this is possible, this technique is wasteful of wafer area, and thus makes the one-piece semiconductor manifold not only costly, but also fragile and prone to breakage.

From the foregoing, it can thus be seen that a need exists for a technique to make a semiconductor manifold for an ink jet printhead that is cost effective and better adapted for page wide applications. Another need exists for a technique for fabricating a tiled ink manifold that better utilizes the area of a semiconductor wafer, and facilitates assembly of the printhead components.

SUMMARY OF THE INVENTION

According to one embodiment of the invention, a page wide ink manifold is fabricated with multiple sections or tiles, which are placed together so that the interfaces thereof are at non-critical locations with respect to the ink ports of the offset printheads of the page wide print mechanisms.

According to a feature of the invention, multiple, substantially identical semiconductor tiles are fabricated with ink channels and ports therein, and arranged end to end on a page wide base member. The base member also includes ink passages to couple different colors of ink from respective ink reservoirs to the tiled manifold. Across the seams, or boundaries of the manifold tiles, there are placed printheads in an offset manner to span the width of the print medium to be printed. The boundary of each manifold tile is located between ink inlet ports on the bottom of a respective printhead, so that no liquid ink is required to pass across the boundary of the manifold tiles.

According to another feature of the invention, an outlet ink port of each manifold tile can feed liquid ink to the inlet ports of both neighbor offset printheads.

With regard to one embodiment of the invention, disclosed is a page wide inkjet print mechanism for printing characters on a print medium. The print mechanism includes a plurality of inkjet printheads for depositing ink dots on the print medium. A plurality of tiles form a tiled ink manifold for carrying liquid ink from an ink source to the plurality of printheads. The tiles of the ink manifold are arranged together to span a substantial width of the print medium, and the printheads are fastened to the tiled manifold to form an integral unit.

In accordance with another embodiment, disclosed is a page wide inkjet print mechanism for printing characters on a print medium. The print mechanism includes a plurality of inkjet printheads for depositing ink dots on the print medium, where each printhead has at least one inlet ink port. Further included is a base member that has outlet ink ports for coupling liquid ink from an ink source to the outlet ink ports of the base member. A plurality of individual tiles is provided, where the tiles form a tiled ink manifold when arranged in a row. Each tile has an outlet ink port for carrying liquid ink to the corresponding inlet ink port of one of the printheads, and each tile has an ink channel for carrying liquid ink from an outlet ink port of the base member to the outlet ink port of the tile. The tiled ink manifold is arranged to span a substantial width of the print medium.

In yet another embodiment of the invention, disclosed is a method of fabricating a page wide inkjet print mechanism for printing characters on a print medium. The print mechanism is fabricated by forming a plurality of individual tiles from a semiconductor wafer. At least one ink channel is formed in one surface of each tile to an opposite surface. Each individual tile is arranged end to end on a base member and bonded thereto so that the ink channel of each said tile is aligned with a respective ink outlet port of the base member, and a seam where each tile is adjacent a neighbor tile defines a boundary. A printhead is located over each boundary so that different ink ports of each printhead are in liquid communication with respective different ink passages of the manifold tiles on each side of the boundary. An inkjet printhead is fastened to the neighbor tiles over a boundary of the tile manifold.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
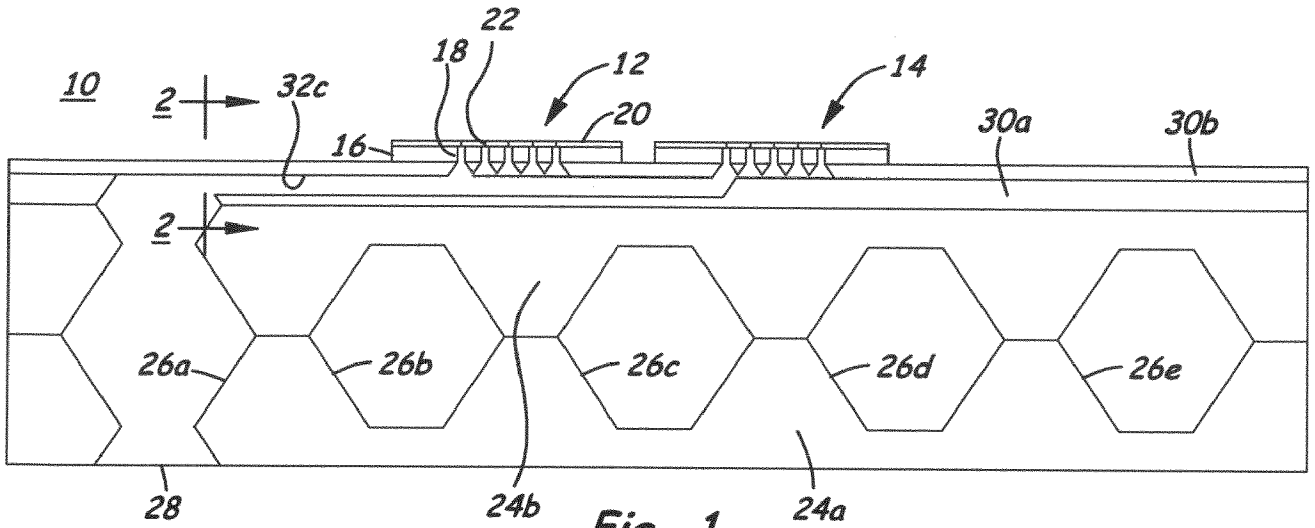
Fig. 1 (PRIOR ART)
FIG. 1 is a cross-sectional view of an ink manifold assembly and a pair of offset printheads for a page wide print mechanism known in the prior art.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof is meant herein to encompass the items listed thereafter and equivalents thereof as well as additional items. Unless otherwise limited, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

FIG. 1 illustrates an ink manifold assembly 10 constructed according to techniques known in the prior art. The ink manifold 10 is adapted for coupling a plurality of colors of liquid ink to respective nozzles of the individual printheads, two of which are shown as numerals 12 and 14. While only two printheads 12 and 14 are illustrated, in practice there are usually many other similarly offset printheads coupled to the ink manifold assembly 10 to provide a page wide print mechanism. The print medium passes adjacent the printheads 12 and 14 in the direction either left or right on the page of FIG. 1. While the illustrated ink jet print mechanism can be oriented in various positions, the print mechanism is generally inverted from that shown, so that the jets of the individual printheads are oriented downwardly as the print medium passes left or right under the ink jet printheads 12 and 14.

The printhead 12 is constructed according to known techniques using a semiconductor material to form the circuits therein for firing droplets of ink from the nozzles, one shown as numeral 18. A typical printhead 12 is constructed with many nozzles 18. Many times, several hundred nozzles 18 are formed in a very small area to provide a large number of dots per unit of paper length. The size of the semiconductor printhead 12 can be anywhere from about 6 mm to 25 mm in length and about 2 mm to 10 mm in width. The printhead 12 can range from about 300 micron to 800 micron in thickness However, these dimensions are not a limit on the practice of the ink delivery manifold of the invention. As noted above, for page wide applications, the plurality of printheads are alternately offset from each on a unitary ink manifold which spans the width of the print medium being printed.

Attached to the top of the printhead 12 is a nozzle plate 20 having formed therein the miniature nozzle openings 22 that function to jet the droplets of ink therefrom when nucleated by a respective nozzle heater in the semiconductor printhead 12. In the embodiment illustrated, the printhead 12 is constructed with many rows and columns of nozzles 18, one column shown with a respective nozzle for each of the five rows, it being understood that there are many nozzles in each row. Each row of nozzles is adapted to print a respective color, such as cyan, magenta, yellow, and two nozzle rows that print black ink. Other colors of inks and other liquids can be printed, such as a precoat liquid that prevents the subsequently deposited ink dots from soaking into the print medium. The page wide printhead mechanism can also be adapted for printing monochrome characters, if desired.

Because of the utilization of numerous different inks and liquids during the printing process, the ink channels are required to not only be separated from the other channels, but take circuitous paths in the manifold assembly 10 to feed ink to each of the associated nozzles of the individual printheads. It can be appreciated that when hundreds of nozzles are involved for each printhead, and with multiple printheads, as well as multiple colors of ink, the reliable routing or coupling of ink to the respective nozzles of all of the printheads can be extremely complicated.

Figure 2:
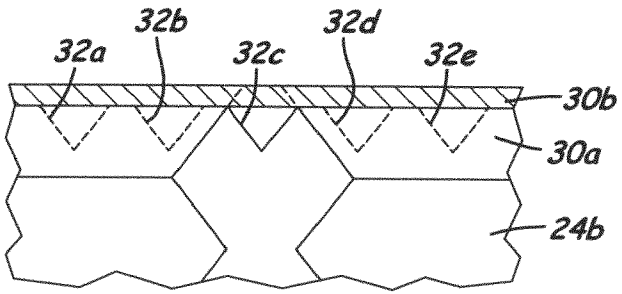
FIG. 2 is a cross-sectional view of the ink manifold assembly of FIG. 1, taken along line 2-2 thereof.

The manifold assembly 10 functions to provide various colors of ink from respective ink reservoirs or supplies, to the individual ink channels and thus to the multiple printheads of the print mechanism. In FIGS. 1 and 2, the manifold assembly 10 is shown with a two-piece silicon ink supply structure 24*a* and 24*b*. Elongate ink supply conduits 26 are partially formed in each ink supply structure 24*a* and 24*b*, so that when attached together, a hexagonal-shaped conduit is formed. The ink supply structures 24*a* and 24*b* can be bonded together by various techniques, including direct room temperature bonding, fusion bonding, eutectic, anodic, adhesive and other suitable techniques. In the illustrated embodiment, there is a separate ink supply conduit 26 for each color of ink. Since there are five rows of nozzles in the printheads in the example, each adapted for printing with a different color, there is a corresponding ink supply conduit 26*a*-26*e* for each color. The ink supply conduits 2*a*-26*e* are adapted for carrying ink in a direction which would be into the drawing. The ink supply conduit 26*a* receives ink from an inlet 28 which is coupled to a reservoir of liquid ink. The other four ink supply conduits 26*b*-26*e* are similarly connected with respective inlets (not shown) to separate reservoirs of liquid ink. As noted above, in the illustrated embodiment, two rows of nozzles in the printheads utilize the same black ink, and thus such rows of nozzles are coupled through the manifold assembly 10 via conduit 26*e* to the same reservoir of black ink.

While not shown, the silicon ink supply structure 24*a* and 24*b* is supported on a base member (not shown) which is often constructed of a durable and rigid plastic or ceramic material that spans the width of the print medium. The base member includes holes therein for coupling the inlets 28 of each of the five ink supply conduits 26*a*-26*e* to the respective ink reservoirs. In practice, the base member is coupled to the respective ink reservoirs by flexible tubes, or the like.

Attached to the top of the ink supply structure 24*a* and 24*b* is a two-part silicon ink channel structure 30*a* and 30*b*. The two-part ink channel structure 30*a* and 30*b* can be bonded together in the same manner as the two-part ink supply conduit structure 24*a* and 24*b*. The ink channel structure 30*a* and 30*b* is constructed with plural channels 32*a*-32*e* (FIG. 2). The ink channel, for example channel 32*c*, couples ink from a respective ink supply conduit 26*a* to the associated row of nozzles in both printheads 12 and 14. Other similar ink channels are connected between the ink supply conduit 26*a* to the same row of nozzles in the other printheads (not shown) of the page wide printhead mechanism. As shown in FIG. 2, there are four other ink channels 32*a*, 32*b*, 32*d* and 32*e* that carry other colors of ink from the other ink supply conduits 26*b*-26*e* to the other rows of nozzles in the printheads. According to the prior art techniques, each ink channel structure 30*a* and 3*b* is constructed from a single piece of silicon, and is about the same length (as measured into the drawing) as the print medium being printed. When the print mechanism is adapted for printing conventional letter-size paper, then the silicon wafers from which the ink channel structures are constructed are required to be no less than about eight and one-half inches in diameter. It can be seen that the yield of ink channel structures from, conventional size semiconductor wafers can be very low. The yield increases with increasing diameter wafers, but large wafers are more costly and more prone to breakage during handling.

Figure 3:
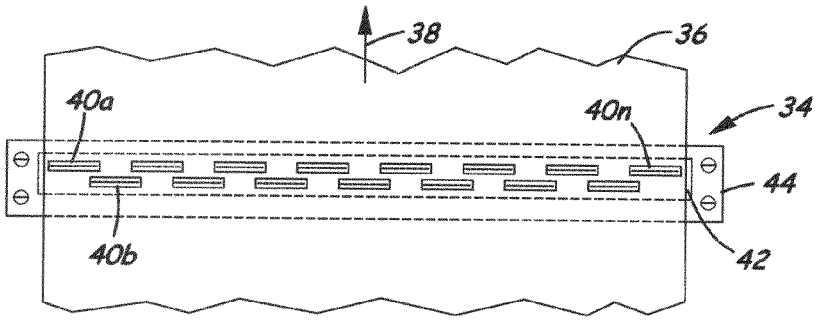
FIG. 3 is a bottom view of a page wide print mechanism that spans the width of the print medium.

FIG. 3 illustrates a bottom view of a page wide inkjet print mechanism 34 for printing characters on a print medium, such as a sheet of paper 36. The print mechanism 34 spans the width of the sheet of paper 36 and prints the characters thereon by way of many ink droplets, as the paper 36 is moved by a carriage apparatus (not shown) in the direction of arrow 38. The printheads 40*a*, 40*b* . . . 40*n* are situated on an ink manifold 42 so that neighbor printheads are offset from each other, as shown. With this arrangement of printheads 40, the nozzles of each printhead are spaced a predefined standard distance from each other, and the last nozzle of one printhead is spaced from the first nozzle of the neighbor printhead the same standard distance. As such, the offset nature of the printheads 40 does not present a discontinuity between the dots of a line of ink dots printed on the medium 36. While not shown in detail in FIG. 3, the ink manifold structure 42 is tiled, or segmented, so that a unitary piece of semiconductor material is not needed in order to form the entire semiconductor manifold structure 42. The semiconductor manifold structure 42 is attached to a ceramic base member 44 which can be fastened to the printer chassis, or the like, so that the print medium 36 can pass thereunder in close proximity to the printheads 40.

Figure 4:
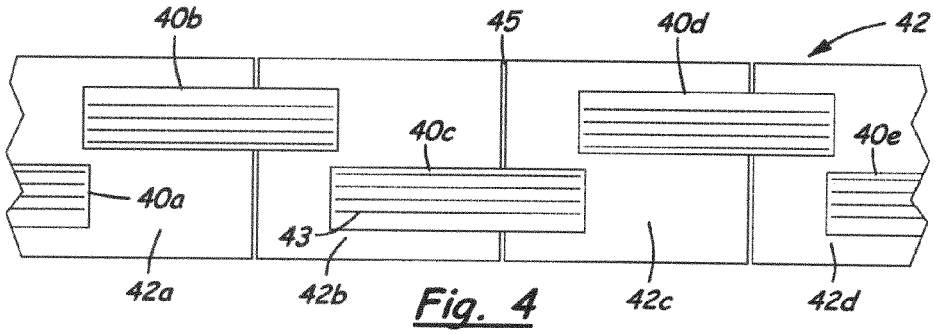
FIG. 4 is a plan view of a portion of a page wide print mechanism, showing a tiled ink manifold with individual printheads attached thereto.

FIG. 4 is an enlarged view of a portion of the tiled ink manifold 42. Each tile 42 is about the length of a printhead 40, and in the illustration there are about as many ink manifold tiles 42 as there are printheads 40. As described in more detail below, the boundary or interface 45 between each tile 42 comprises a small space, and is situated with respect to the printhead inlet ink ports so that no ink flows across the boundary 45 between the tiles 42*b* and 42*c*. The printheads, such as printhead 40*c*, includes plural rows and columns of nozzles, one row shown as numeral 43. The printheads 40 need not be specially constructed for use with the tiled ink manifold 42 of the invention. Rather, the principles and concepts of the tiled ink delivery manifold 42 can be employed with conventionally available ink jet printheads.

Figure 5:
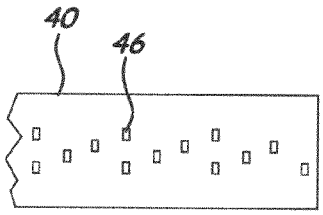
FIG. 5 is a bottom view of an individual printhead illustrating the inlet ink ports.

FIG. 5 illustrates the bottom surface of a portion of a printhead 40, with an arrangement of inlet ink ports that receive a supply of ink and couple the ink internally via channels to the various nozzles. The rows and columns of nozzles are located on the top of the printhead 40. Various ink ports 46 are supplied with the different colors of liquid ink. While the arrangement of ink ports 46 is illustrated for a certain printhead 40, the invention can be constructed to accommodate printheads with other arrangements of inlet ink ports.

Figure 6:
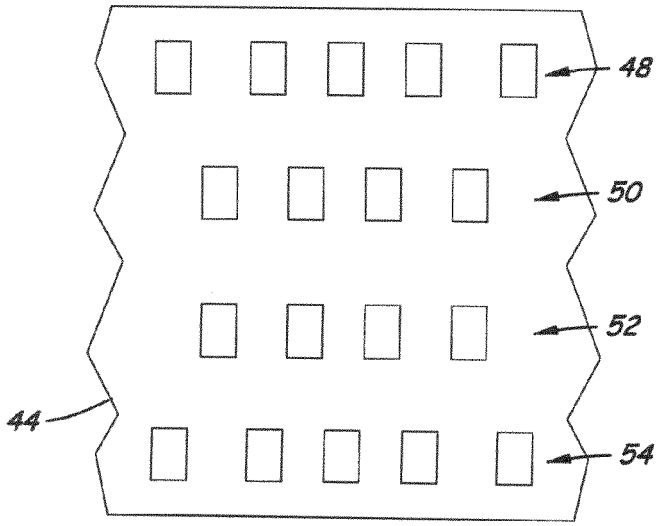
FIG. 6 is a top view of a base member illustrating the outlet ink ports.

FIG. 6 illustrates a portion of a ceramic base member 44 with an arrangement of ink ports for coupling the different color ink reservoirs thereto. In a four-color ink print system, the first row of ink ports 48 receive a first color ink, such as cyan-colored ink. A second row of ports 50 receive a second color ink, such as magenta-colored ink. A third row of ports 52 receive a third color ink, such as yellow, and a fourth row of ports 54 receive a fourth color ink, such as black. A function of the tiled manifold 42 is to provide an interface between the ink ports on the bottom of the printheads 40, as shown in FIG. 5, and the ink ports on the top of the ceramic base member 44, as shown in FIG. 6. To that end, it is a feature of the tiled manifold 42 of the invention to provide a manifold structure that can be easily bonded to the printheads 40 as well as the base member 44, and also to be constructed with material that is closely matched in temperature coefficient with the materials to which it is attached.

Figure 7:
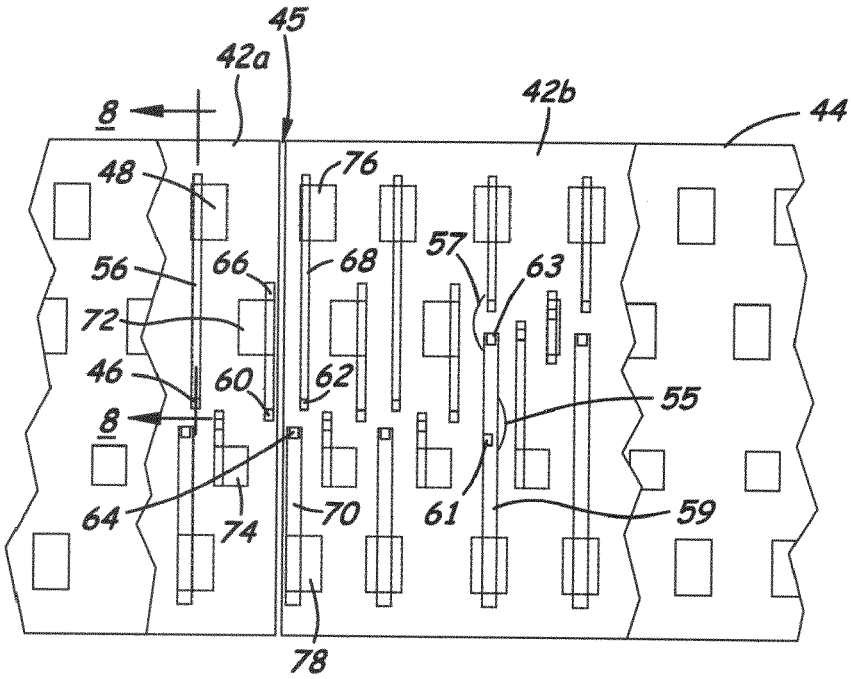
FIG. 7 is a top view of a portion of the ink manifold, with two tiles shown attached to the underlying base member.

FIG. 7 is a top view of neighbor manifold tiles 42*a* and 42*b* and the channel structures for coupling the underlying ink ports of the ceramic base member 44 to the inlet ink ports of the overlying printhead 40. One ink channel 56 formed in the semiconductor ink manifold 42*a* is illustrated as connecting the outlet ink port 48 of the underlying ceramic base member 44 to the inlet ink port 46 of the overlying printhead 40.

Figure 8:
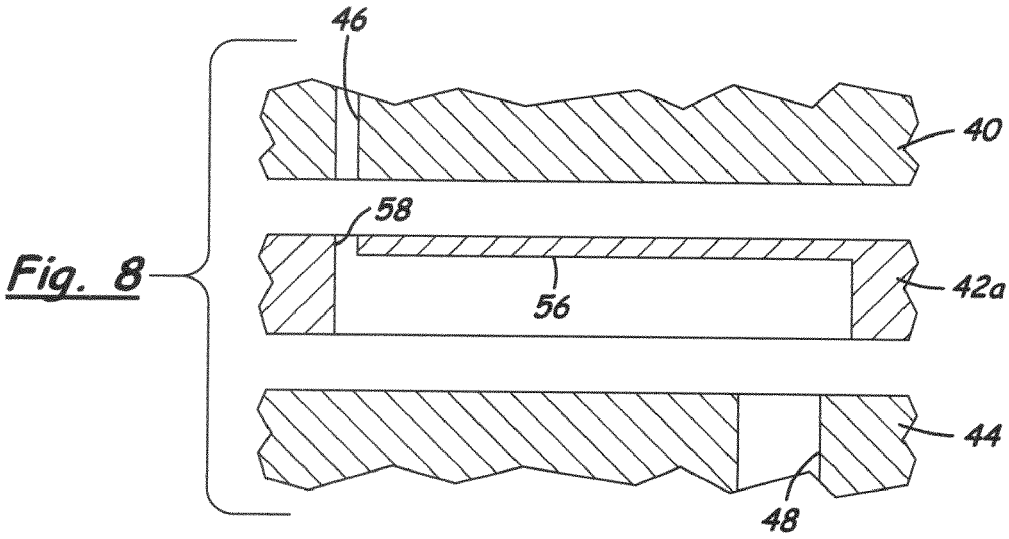
FIG. 8 is a cross-sectional view of a portion of a printhead, an ink manifold tile, and the underlying base member, all illustrating the circuitous ink channels through the components of the printhead mechanism.

FIG. 8 illustrates in more detail the features of the tiled ink manifold 42*a*, taken along the line 8-8 of FIG. 7. Here, the top surface of the ink manifold 42*a* is constructed with an outlet ink port 58 that is aligned with the bottom inlet ink port 46 of the printhead 40. Formed in the bottom of the ink manifold 42*a* is the ink channel 56 which overlies at least a portion of the outlet ink port 48 of the underlying base member 44. Accordingly, ink flows from the reservoir (not shown) through the base member 44 to the outlet port 48, then into the manifold 42*a* via the channel 56 to the tile outlet ink port 58, and into the inlet ink port 46 of the printhead 40. The length and cross-sectional area of the ink channel 56 is selected to minimize the fluidic resistance of the ink flowing therethrough. The remainder of the ink channels and the outlet ports in the manifold 42*a* are similarly constructed to provide a passage for ink, flow from the outlet ports of the base member 44 to the respective inlet ink ports of the printheads 40.

The ink manifold 42*a* is constructed in the following manner. Semiconductor wafers of various sizes can be employed. However, six or eight inch wafers can be advantageously utilized because of the wide usage thereof, as well as processing facilities for fabricating the features on the wafers. Smaller or larger wafers can be used to make the individual tiles of the manifold 42*a*. In any event, the wafer is masked on one side thereof to define the outlet ports 58 for each tile, it being realized that the construction of each tile is identical, with the possible exception noted below. A fiducial is also masked to identify reference locations on each tile. The opposite side of the wafer is covered with an etch resistant material. The wafer is then subjected to a deep reactive ion etch process in which the outlet ink ports 58 are formed into the wafer. The depth of the etching of the outlet ink ports 58 is not critical, but can be between 30-70 micron, depending on the thickness of the wafer being processed. The mask is then removed by conventional techniques, as is the etch resistant cover on the other side of the wafer.

The wafer is then processed on the opposite side by forming a mask thereon to define the location and size of the ink channels 56 for each tile. As noted above, the size of the ink channels can differ, depending on the length of the ink path and the number of nozzles being supplied with ink. The cross-sectional area of each channel is determined to minimize the fluidic resistance and facilitate the flow of liquid ink therein during printing. An etch stop, such as $SiO_2$, is deposited in the outlet ink ports 58 on the other side of the wafer to prevent further etching of the already-formed outlet ports 58. A deep reactive ion etch is again conducted to form the ink channels 56 into each tile of the wafer. The depth of the etch is such that the channels 56 intersect the outlet ports 58 previously etched on the other side of the wafer. A continuous ink path is thus formed from one side of each tile to the other side of the respective tiles. As noted in FIG. 7, many ink channels are formed in each tile. There are typically as many ink channels as there are inlet ink ports on the bottom of the respective printheads. However, a single tile of the ink manifold can supply ink to different printheads. The channel-defining mask is then removed, and a wet etch is employed to selectively remove the etch stop within the outlet ink ports 58 on the other side of the wafer.

Those skilled in the art may find it advantageously to form the channels 56 entirely through the manifold tiles 42 and eliminate the outlet ink port 58. In this regard, the outlet ink port would be the same as the ink channel itself. With this technique, the wafer need only be processed on one side thereof.

The extreme end manifold tile at the right end of the print mechanism and the left end of the print mechanism can be fabricated differently. The right end and left end ink manifold tiles can be formed in a modified manner to include only sufficient channels and ink outlets to accommodate the overlying end printhead. In other words, the end tiles may be formed with the same length as the other tiles, but that portion of the tile extending beyond the end of the first and last printhead can be formed without any ink channels (blank) and corresponding ink outlets, as there is no portion of a printhead overlying the same. It is realized that beyond the end of the last printhead, there is also no ink outlets 48 in the base member 44. As an alternative, the end tiles of the print mechanism, can be constructed identical to the other tiles, with the unused ink channels and outlet ink ports being bonded to the blank portion of the underlying base member so that no ink flows through the unused ink passageways that extend beyond the end printhead. As yet another alternative, the end ink manifold tiles could be formed with a partial length that terminates at the end of the overlying printhead. However, the first and third alternatives involve the use of two or three different types of tiles in fabricating a print mechanism, and different assembly jigs and techniques.

During assembly of the print mechanism, the semiconductor tiles 42 are aligned and bonded to the ceramic base member 44. Various alignment mechanisms for aligning the miniature features of one component to another are well known in the art. The bonding agent can be an adhesive of the epoxy type, or other suitable adhesive, that exhibits a temperature coefficient similar to that of both of the components to be fastened together. Once the manifold tiles 42 are bonded to the underlying base member 44, the printheads 40 are bonded to the tiled ink manifold 42. As noted above, the direct room temperature bond is well adapted for bonding semiconductor components together. However, other types of molecular and mechanical bonding agents and techniques can be used.

With reference back to FIG. 7, it can be seen that the outlet ink port 48 in the base member 44 is much wider than the ink channel 56. This allows for slight misalignment between the ink manifold tile 42*b* and the base member 44, without adverse ramifications. The width of each ink channel 56 can be wider than the inlet ink port 46 on the bottom of the printhead 40 to also allow for slight misalignment without presenting a restriction on the flow of ink through the passageway at the interface between the components.

At the location where adjacent printheads are offset, an ink channel and corresponding outlet ink ports of a manifold tile can feed inlet ports of both offset printheads. This is shown in FIG. 7, where the bottom grouping 55 of ink inlet ports are associated with one printhead (not shown) and the other grouping 57 of inlet ink ports is associated with the neighbor offset printhead. The bottom grouping 55 of inlet ink ports for one printhead extends to the left in the drawing, across the boundary 45. The other grouping 57 of inlet ink ports of the other printhead extends to the right in the drawing. It can be seen that the inlet ink port 61 of one printhead is aligned with the inlet ink port 63 of the other printhead. Accordingly, the ink channel 59 formed in the manifold tile 42*b* is fabricated with two corresponding outlet ink ports (not shown) that serve to supply liquid ink to the respective inlet ink ports 61 and 63 of both offset printheads.

Figure 9:
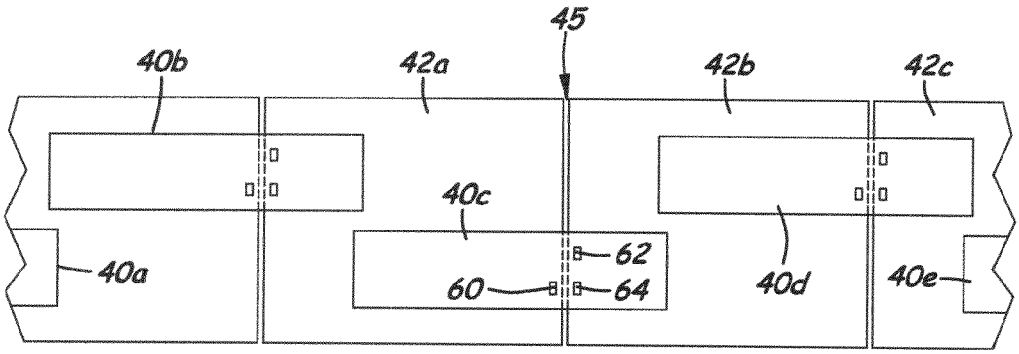
FIG. 9 is a plan view of the placement of printheads across the boundaries of the tiled manifold.

In the preferred embodiment, a boundary between each tile lies between the ends of each printhead 40. In other words, there are about as many ink manifold tiles 42 as there are printheads 40 for a page wide print mechanism. The boundary 45 between the neighbor tiles 42*a* and 42*b* constitutes a small space, of several microns, and preferably about 8-12 microns, to allow for alignment of the individual printheads 40 on the ink manifold tiles. The spacing between the tiles 42 also allows for thermal expansion. According to a feature of the invention, the boundary 45 between tiles 42 is chosen to be between selected inlet ink ports of the respective printheads 40. This is shown in FIGS. 7 and 9 where the boundary 45 between tiles 42*a* and 42*b* is located between the ink inlet port 60 of the printhead 40*c* on one side of the boundary 45, and ink inlet ports 62 and 64 of the same printhead 40*c* on the other side of the boundary 45. The ink inlet ports 60, 62 and 64 are on the same printhead 40*c* that spans the boundary 45 between the two ink manifold tiles 42*a* and 42*b*. Because the boundary 45 is located between the ink inlet ports of the overlying printhead, no liquid ink is required to pass across the boundary 45 between the tiles 42*a* and 42*b*. When the printheads 40 are bonded to the manifold tiles 42, such as by direct bonding, a seal is made between the semiconductor surfaces of the printhead chip and the ink tile chips. By way of example, a peripheral seal is made between the tile 42*a* and around the overlying printhead inlet ink port 60, and between the neighbor tile 42*b* and around each of the inlet ink ports 62 and 64 of the same printhead 40*c*.

On the bottom side of the ink manifold tiles 42*a* and 42*b*, a seal is also made around the ink-carrying passageways to the underlying base member 44. Again, no liquid ink is required to pass across the boundary 45 between the tiles 42*a* and 42*b* on the bottom sides thereof. To that end, the ink channel 66 formed on the undersurface of the tile 42*a* is on one side of the boundary 45, and the ink channels 68 and 70 of the tile 42*b* are on the other side of the boundary 45. Similarly, the outlet ink ports 72 and 74 of the base member 44 are on one side of the boundary 45, and the ink outlet ports 76 and 78 of the base member 44 are on the other side of the boundary 45. The other printheads 40 of the print mechanism are similarly arranged and bonded on the respective tiles 42, as are the tiles 42 on the underlying base member 44.

Figure 10:
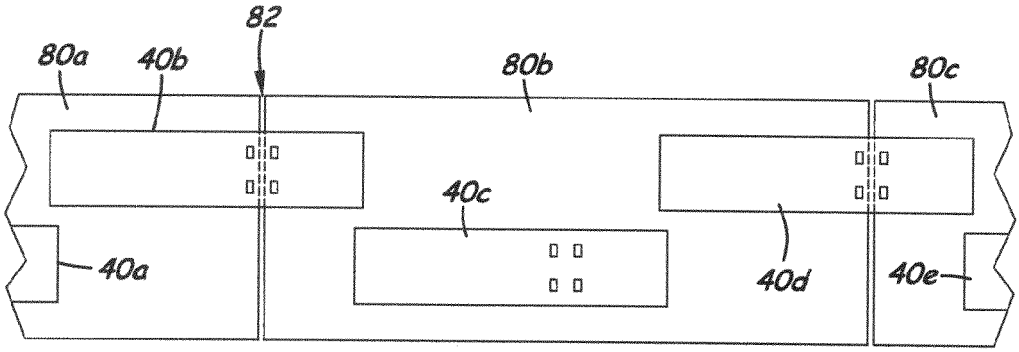
FIG. 10 is a plan view illustrating another technique of arranging manifold tiles with printheads thereon.

While the preferred embodiment of the invention utilizes a tiled ink manifold that has a boundary extending through each neighbor printhead, this is not necessary to the practice of the invention. FIG. 10 illustrates another embodiment in which the manifold tiles extend to every other printhead. In the example of FIG. 10, the ink manifold tile 80*b* extends from the printhead 40*b* to printhead 40*d*. There is no tile boundary with respect to the intermediate offset printhead 40*c*. As with the embodiment described in connection with FIG. 9, the tile boundary, such as boundary 82, is located between the inlet ink ports of the printhead 40*b*. With this arrangement, the manifold tiles 80 are longer than those of the embodiment of FIG. 9, but nevertheless are more efficiently made using a semiconductor wafer than the one-piece page wide semiconductor manifolds. Yet other manifold tiling arrangements are possible to achieve an efficiency in the utilization of the semiconductor wafers.

The tiling of the ink manifold can also be employed in page wide printhead mechanisms that do not utilize offset printheads. Rather, the tiling of the ink manifold can be employed when the printheads are all aligned along a common axis. Moreover, those skilled in the art may find that the boundary between the tiles of the manifold can be coincident with the ends of the adjacent and offset printheads, rather than through the printhead at an intermediate location thereof. In addition, the edges of the adjacent manifold tiles that form the boundary need not be linear edges, but can be nonlinear to take into account the best location between the features of both the base member and the printheads so that no liquid ink is required to pass across the boundary. In other words, the edges of the tiles that form the boundary can be zig-zag shaped so as to be located between ports or other features.

From the foregoing, the description of the methods and apparatus of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A micro-fluidic ejector device, comprising:

a plurality of ejector heads for depositing fluid on a medium;

a plurality of tiles forming a tiled manifold for carrying a liquid from a liquid source to the plurality of ejector heads;

the tiles of the manifold arranged together to span a substantial width of the medium; and said ejector heads fastened to the tiled manifold to form an integral unit, wherein the tiles of said tiled manifold each include an elongate channel, where the same elongate channel supplies a liquid to a respective inlet port of two offset ejector heads.

2. The micro-fluidic ejector device of claim 1 wherein ones of said manifold tiles are identically made.

3. The micro-fluidic ejector device of claim 1 wherein each said manifold tile is arranged adjacent to a neighbor manifold tile to define a boundary therebetween, and wherein each said ejector head overlies a respective said boundary.

4. The micro-fluidic ejector device of claim 3 wherein the boundary of said neighbor manifold tiles is located between inlet ports of said overlying ejector head.

5. The micro-fluidic ejector device of claim 1 wherein the tiles of said tiled manifold each include an elongate channel formed on one side thereof, and include a port formed on an opposite side thereof, where said channel is in fluidic communication with said port.

6. The micro-fluidic ejector device of claim 1 wherein said tiled manifold is constructed of a semiconductor material.

7. A micro-fluidic ejector device, comprising:

a plurality of ejector heads for depositing fluid on a medium;

a plurality of tiles forming a tiled manifold for carrying a liquid from a liquid source to the plurality of ejector heads;

the tiles of the manifold arranged together to span a substantial width of the medium;

said ejector heads fastened to the tiled manifold to form an integral unit;

a base member to which said tiled manifold is fastened, said base member coupling a liquid from one or more liquid reservoirs to said tiled manifold, wherein said base member is constructed with outlet ports, and said tiled manifold is constructed with channels, and when said tiled manifold is fastened to said base member, the ports of said base member are in fluid communication with respective channels of said tiled manifold and each outlet port of said base member is wider than a respective channel of said tiled manifold to thereby allow some misalignment of said tiled manifold with respect to said base member.

8. The micro-fluidic ejector device of claim 7 wherein said base member is constructed of a ceramic material.

9. The micro-fluidic ejector device of claim 7 wherein said tiled manifold includes outlet ports adapted for coupling to a printhead, and the outlet ports of said tiled manifold are coupled to respective channels of said tiled manifold, and wherein said outlet ports of said tiled manifold are wider than corresponding inlet ports of said ejector head to thereby allow some misalignment of said ejector head on said tiled manifold.

* * * * *